United States Patent [19]

Deruntz

[11] Patent Number: 4,846,236

[45] Date of Patent: Jul. 11, 1989

[54] BOTTLED WATER DISPENSER INSERT

[76] Inventor: William R. Deruntz, 21672 Treeshade La., El Toro, Calif. 92630

[21] Appl. No.: 69,758

[22] Filed: Jul. 6, 1987

[51] Int. Cl.[4] ..... B65B 3/04; B67D 3/00

[52] U.S. Cl. ..... 141/329; 141/319; 222/81; 222/89; 62/294; 62/331

[58] Field of Search ..... 141/329, 330, 319, 2, 141/18, 19, 363, 98; 222/83, 83.5, 81, 88, 89; 62/293, 294, 331, 389, 390

[56] References Cited

U.S. PATENT DOCUMENTS

| | | | |
|---|---|---|---|
| D. 277,255 | 1/1985 | Deruntz | D7/387 |
| 1,028,542 | 6/1912 | Christian | 141/330 |
| 1,142,210 | 6/1915 | Wagner | 222/88 |
| 1,241,352 | 9/1917 | Doering et al. | 141/330 X |
| 1,248,705 | 12/1917 | Pouge | 62/294 |
| 1,337,206 | 4/1920 | Doering et al. | 141/330 X |
| 1,355,195 | 10/1920 | Van Orsdale | 222/88 X |
| 1,619,708 | 3/1927 | Dietrick | 141/370 X |
| 1,979,323 | 11/1934 | Felesina et al. | 141/330 X |
| 2,002,611 | 5/1935 | Nall | 141/330 |
| 2,017,818 | 10/1935 | Reynolds | 141/330 |
| 2,350,451 | 6/1944 | Embrey | 141/330 X |
| 2,806,635 | 9/1957 | Kader et al. | 222/88 |
| 3,115,908 | 12/1963 | Carlson et al. | 141/330 |
| 3,254,799 | 6/1966 | Gardner et al. | 222/88 |
| 3,434,629 | 3/1969 | Hooge et al. | 222/88 |
| 3,538,866 | 11/1970 | Gaines | 222/83.5 X |
| 3,934,623 | 1/1976 | Hays | 141/98 |
| 4,146,156 | 3/1979 | Cassia | 141/330 |
| 4,289,255 | 9/1981 | Strampe | 222/81 |
| 4,322,019 | 3/1982 | Smith | 222/83.5 |
| 4,597,423 | 7/1986 | Chenot | 141/330 |
| 4,699,188 | 10/1987 | Baker et al. | 141/18 |

FOREIGN PATENT DOCUMENTS

| | | | |
|---|---|---|---|
| 2020253 | 11/1979 | United Kingdom | 222/83 |

*Primary Examiner*—Ernest G. Cusick
*Attorney, Agent, or Firm*—Stetina and Brunda

[57] ABSTRACT

A dish-like member positioned between an inverted bottled water container and the uppermost portion of the water reservoir of a bottled water dispenser includes a star-shaped penetrating and spreading element extending axially therefrom which incorporates two knife-type edges particularly adapted for cutting and penetrating the plastic seal of a bottled water container and two orthogonally positioned spreader-type edges particularly adapted for separating the penetrated seal without cutting and allowing free-flow of water therethrough. The dish-like member including plural interior ribs which are spaced, size, and adapted in circumferential separation to frictionally engage the neck portion of a standard bottled water container prior to penetration of the seal thereof. By such engagement the insert may be removed to and from its position intermediary the bottled water container and the bottled water dispenser in a position upon the neck of the bottled water container.

2 Claims, 1 Drawing Sheet

Fig. 1
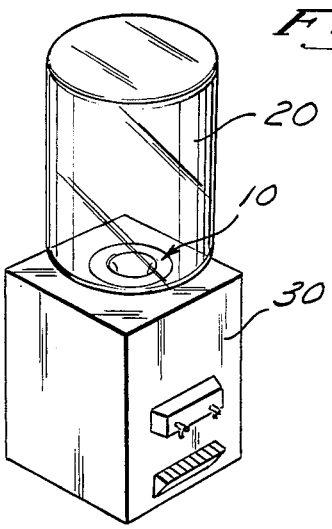
Fig. 2
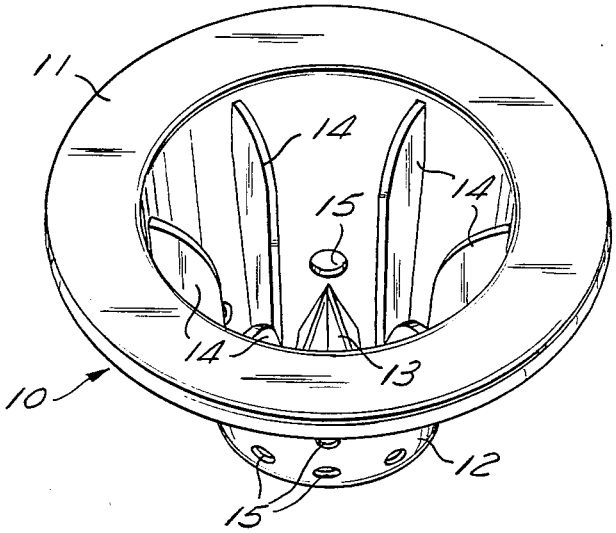
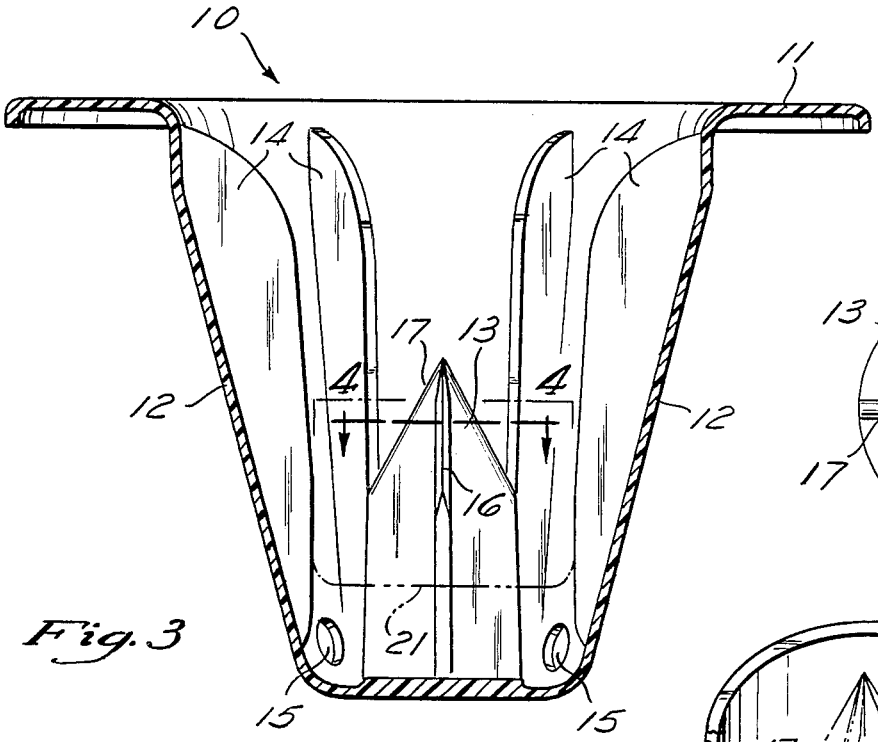
Fig. 3
Fig. 4
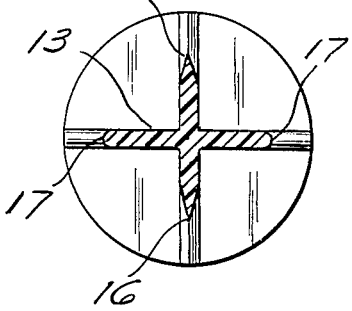
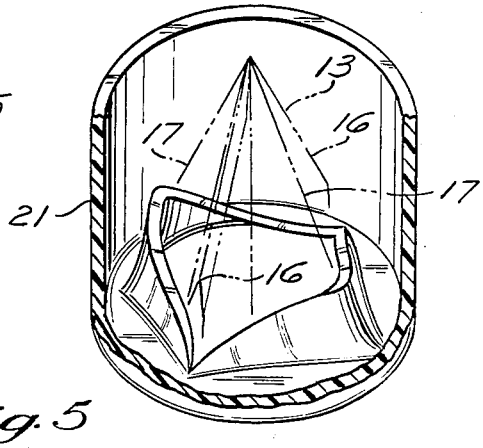
Fig. 5

BOTTLED WATER DISPENSER INSERT

BACKGROUND OF THE INVENTION

The present invention concerns bottled water dispensers, and more particularly concerns inserts which fit between commercial bottled water containers and water dispensing apparatus.

Dispensers of drinking water, non-aerated beverages, and the like in which a fluid-containing bottle is inverted upon a water-receiving dispenser vessel, which vessel may incorporate a cooler, are known in the prior art. In the refilling of bottled water dispensers it is, of course, necessary to replace an empty water bottle with an additional full one. In order to effectuate this replacement, the full bottle must typically be unsealed by the removal of a cork, plastic seal, plastic end cap or the like. The opened water bottle is then inverted onto a complementary inlet port of the dispenser with its open end facing in a downward position. In this position the water will pour out of the bottle until the level of water in the vessel has risen slightly above the plane of the open end or mouth of the bottle. When the water in the dispenser vessel reaches this level, the water cannot escape from the water bottle by reason of the fact that air cannot enter the bottle to displace the water. When, however, water is drawn off from the dispenser, normally through a faucet, during normal use then the water level within the vessel will fall. This falling level allows enough air to be admitted to the bottle so as to permit sufficient water to escape as to restore the level of the water in the vessel. The level of the water in the vessel thus remains constant, and never rises more than slightly above the plane of the mouth of the bottle—either when the bottle is first placed in the cooler or thereafter. This is the basic operational principle of bottle water dispensers and coolers which have been in use for many years.

Despite the long history of the bottled water dispenser devices, the replacement of a new, full, water bottle in substitution for an old, empty, water bottle remains troublesome. Particularly, the water is subject to splash from the full bottle during the course of its inversion onto the inlet port of the dispenser. This splashing is especially great when the inversion is performed slowly, or awkwardly, as is often the case when the water bottle is attemped to be manipulated by low physical strength users.

If this spilling is attempted to be eliminated by the placement of the user's hand over the mouth of the bottle, then upon inversion of the bottle, the palm of the hand is brought into direct contact with the drinking water which is typically unsanitary. Further, even if a user is very skillful and is able to place the water bottle in its inverted position within the dispenser by a quick tilting movement, a considerable quantity of water typically will escape the bottle during such movement and fill the water recepticle of the dispenser to a height above its normal operational water level above the mouth of the bottle. Thereby any dirt or contamination which may be present upon the outside of the neck of the bottle may be washed off into the drinking water. This little-considered effect means that even those who are physically skillful in the loading of water bottles into dispensers may, despite the absence of any spillage, temporarily induce an abnormal and potentially unsanitary condition within the water dispenser.

Because of these problems, it is known in the prior art to provide special funnels, or inserts, between containers holding liquids and recepticles receiving such containers in order to dispense the liquid therefrom. These containers include, but are not limited to, bottle water containers. The dispensers include, but are not limited to, bottled water dispensers.

U.S. Pat. No. 1,028,542 entitled "MEANS FOR DRAWING LIQUID FROM RECEPTICLES" issued to Christian discloses a funnel adapted to fit in an opening on the edge of a can. The funnel includes a piercer device for piercing the can so that its contents may flow into the funnel.

U.S. Pat. No. 1,142,210 entitled "LIQUID DISPENSING DEVICE" issued to Wagner discloses a bottled water dispensing device having a stand provided with an axial, upwardly projecting, spike or pin. The function of the spike is to perforate the bottle closure when the bottle is inverted upon the water-receiving vessel, and to permit water from the bottle to flow into the vessel.

U.S. Pat. No. 1,248,705 entitled "CONTAINER FOR DRINKING WATER" issued to Pogue further discloses an apparatus for protecting the potentially contaminated neck of a water bottle from contact with the water within the water compartment of a water cooler and water dispenser. A bottle with a relatively thick neck portion has an annular groove which mates with a complementary tongue end of a tubular member defining the input orifice to the water cooler. The bottle seals to the cooler in a water tight, annular ring, tongue and groove type arrangement. The cooler has a piercing device which pierces the sealed neck of the bottle only when the bottle is positioned upright and sealed to the input orifice of the dispenser Pogue also discloses a container for drinking water including a manually activated penetrator member adapted to puncture the seal upon a drinking water container.

U.S. Pat. No. 1,241,352 issued to Doering, Jr., et al., entitled "WATER DISPENSING DEVICE" discloses a resiliant water bottle closure adapted to be opened upon a penetrating member of a water dispenser.

U.S. Pat. No. 1,337,206 issued to Doering, et al., discloses a liquid cooling and dispensing apparatus which uses a penetrator member to rupture the seal upon the water container.

U.S. Pat. No. 1,979,323 entitled "LIQUID DISPENSING AND COOLING DEVICE" issued to Felesina, et al., discloses a liquid dispensing and cooling device having automatic seal-puncturing means retained within the device.

U.S. Pat. No. 2,806,635 entitled "CAN OPENER DEVICE" issued to Kader, et al., discloses a can-opening device adapted to fit upon the top of a pitcher and to puncture a can, releasing the contents of the can into the pitcher.

Of particular pertinence to the present invention is U.S. Design Pat. No. Des. 277,255 entitled "BOTTLED WATER DISPENSER INSERT" to the subject inventor of the present invention. The dispenser insert shown therein may be used to automatically puncture the seal upon a standard commercial bottled water container during installation of this bottled water container upon a standard water cooler. As depicted in the design patent drawing, the invention comprises a dish-like member which may be maintained upon the uppermost portion of the water reservoir of the water cooler. The dish-like member includes a star-shaped penetrator extending axially upwards. When it is desired to install a water bottle upon a water cooler, a user merely inverts the bottle with the cap thereon, and aligns the center portion of the bottle's cap with the star penetrator. Subsequently, the weight of the water in the bottle causes the penetrator to rupture the bottle's cap and to permit the bottle to seat itself upon the top of the bottled water cooler. Due to the insert having apertures adjacent its lowermost end, the water released from the bottle upon the puncturing of the cap is free to travel through the insert and into the reservoir of the water cooler from where it is subsequently dispensed.

The particular bottled water dispenser insert which is shown within U.S. Design Pat. No. DES. 277,255 is well-directed to performing a useful task, but has been found to exhibit functional imperfections in actual use. As a first area of difficulty, the star-shaped penetrator is illustrated to to include four substantially perpendicular knife edges. These knife edges are very effective to cut the nominally plastic cap, or seal, of a bottled water container. However, they may be too effective to do so; essentially quartering the plastic cap into triangular flaps of plastic which then flop, under their normal memory properties and under hydrostatic pressure, inwardly towards the star-shaped penetrator. The cap is thus fully and well severed, but its remaining material tends to detrimentally interact with the penetrator element to preclude full and unrestricted water flow from the container to the dispenser reservoir.

As a second area of difficulty, the prior art bottled water dispenser shown in U.S. Design Pat. No. Des. 277,255 employs four guide ridges to the interior of the insert, which ridges are progressively tapered toward the central penetrator spike. The purpose of the four ridges is to guide the neck of the bottled water container onto the neck of the spike. However, it has been found that they are insufficiently numerous, and inappropriately contoured, to perform reliably. Particularly, when only four ridges are used the neck of a bottle water container may extend between two adjacent ridges and the central penetrator spike, thereby becoming stuck in a position wherein the seal of the bottle water container is not penetrated, and wherein a removal and subsequent reseating may be awkward, difficult, or messy.

Furthermore, the contours of the four interior ridges to the prior art dispenser insert are particularly directed to guiding, but not to engaging, the neck of the water bottle. It is occasionally desired that the insert should be held on the neck of the bottled water container so as to be withdrawn automatically with the bottled water container during replacement, such that the reservoir of the dispenser may be inspected and the insert may be moved to the neck of a new bottled water container. Correspondingly, it would be desireable if the ribs of a bottled water dispenser insert were contoured, and sized, to frictionally engage the neck of a bottled water container so as to retain the insert upon the container, as well as to guide the container onto the inlet orifice of a bottled water dispenser.

SUMMARY OF THE INVENTION

The present invention is embodied in a bottled water dispenser insert of improved contour and design, and in a method of using such improved bottled water dispenser insert. The preferred bottled water dispenser insert in accordance with the present invention includes a dish-like member which is insertable intermediary a reception port of a bottled water dispenser and a water, or other beverage, bottle which is inverted into this reception port. The dish-like member includes a piercing member for penetrating and breaking a puncturable seal of the water bottle in order to permit flow of water into the reception port of the dispenser.

In accordance with the present invention, this piercing member is particularly contoured and structured. Mainly, it exhibits a plurality of knife edges for penetrating and for breaking the puncturable seal, and also exhibits a plurality of seperator edges for spreading the penetrated and broken material of the puncturable seal in order that the flow of water into the reception port may substantially be unobstructed. By the combinatorial action of the sharp knife edges, and the blunt seperator edges, the nominally plastic seal of a bottled water container is both penetrated, and held open after initial penetration.

Further in accordance with the present invention, the dish-like member includes a plurality of rib members formed on the interior of the dish which rib members guide and center the seal of the water bottle onto the piercing member. These rib members are sufficiently numerous, and exhibit sufficient positional tolerance to this guiding and centering, so as to make it impossible that the water bottle be free standing upon the bottled water dispenser without its puncturable seal being directed into direct contact with the piercing member. In this regard, the guidance provided by the rib members represents an improvement over prior art bottled water dispenser inserts.

Further in accordance with the present invention the plurality of the interior rib members to a bottled water dispenser insert are sized and adapted so as to frictionally grasp the bottled water container about its neck. By this grasping, the dish-like member will remain attached to the bottled water container against the force of gravity, upon a removal of the spent bottled water container from the bottled water dispenser. This is opposite to the prior art wherein the dispenser insert remains withnn and with the bottled water dispenser as opposed to remaining with the bottled water container. The utility of so extracting the bottled water insert is that it may be disengaged by hand from the spent bottle and fitted to a new, full, bottled water container. Alternatively, a plurality of dispenser inserts may be employed in ready position upon bottled water containers ready for deployment upon, and within, the bottled water dispenser.

BRIEF DESCRIPTION OF THE DRAWINGS

These as well as other features of the present invention will become more apparent upon reference to the drawings wherein:

FIG. 1 is a perspective view showing the preferred embodiment of a bottled water dispenser insert in accordance with the present invention disposed in its operational environment.

FIG. 2 is a perspective view showing the preferred embodiment of a bottled water dispenser insert in accordance with the present invention.

FIG. 3 is a cross-sectional view of the preferred embodiment of a bottled water dispenser insert in accordance with the present invention.

FIG. 4 is a detail view, partially in cross section, taken along aspect line 4—4 of FIG. 3, particularly showing the penetrator and spreading element of the preferred embodiment of a bottled water dispenser insert in accordance with the present invention.

FIG. 5 is a diagrammatic view, partially in cross section, illustrating the plastic seal, or cap, to a bottled water container and the interaction of this cap with the penetrating and spreading element, previously seen in FIG. 4, of the preferred embodiment of a bottled water dispenser insert in accordance with the present invention.

DESCRIPTION OF THE PREFERRED EMBODIMENT

The present invention is embodied in an improved bottled water dispenser insert which is generally shown in FIGS. 1-4, and in a method of the use of such improved insert. The preferred embodiment of a bottled water dispenser insert 10 is used to automatically puncture the seal 21 (shown in FIG. 5) which is positioned upon the neck of a commercial bottled water container 20 during the inverted installation of this bottled water container 20 upon a water cooler, or dispenser, 30. The bottled water dispenser insert 10 is shown in its opertive position in drawing FIG. 1.

As depicted in the perspective drawing of FIG. 2, the bottled water dispenser insert 10 is substantially in the shape of a dish-like member having a broad annular flange 11 and a bowl 12. The dish-like member centrally mounts an integral star-shaped penetrator and spreader element 13 which extends axially upwards from the bowl 12 of the dish-like member. The bowl 12 includes a plurality of vertically extending guide fins or ribs 14 which are preferably symetrically spaced about its interior. Finally, the bowl 12 of the dish-like member presents at its lower extremity a plurality of apertures 15.

In operative use of the preferred embodiment of a bottled water dispenser insert in accordance with the present invention, the insert may be affixed with the penetrator and spreading member 13 disposed upwardly within the inlet cavity of the bottled water dispenser 30. Alternatively, the insert may be inverted, with the penetrator and spreading element 13 disposed downwardly onto the neck of an upstanding bottled water container 20. In both instances, the penetrator and spreading member 13 will be aligned with the cap or seal 21 of the bottled water container 20 when the bottled water container 20 is finally seated, in its inverted position, upon the bottled water dispenser 30. The user lifts the bottled water container 20, or the bottled water container 20 with the insert 10 affixed upon the neck but not penetrating the seal 21, into its inverted position upon the water dispenser 30. Since the penetrator and spreading element 13 will not puncture and spread the seal 21, as illustrated in FIG. 5, until the bottled water container 20 is firmly seated into the bottled water dispenser 30, spillage of water is eliminated. The weight of the water in the bottled water container 20 is sufficient to cause the penetrator and spreaing element 13 to rupture the plastic cap 21 upon the bottled water container 20, and to permit the bottled water container 20 to substantially seat itself upon the bottled water dispenser 30. Due to the plurality of apertures 15 upon the lower extremity of dish 12 of the bottled water insert 10, the water is released from the bottled water container 20 and is free to travel through the insert 10 into the reservoir of bottled water dispenser 30.

In accordance with the present invention, certain improvements to the geometries of the bottled water dispener insert 10 are obtained. Particularly, the penetrator and spreader element 13, shown in detail cross-sectional view in FIG. 4, possesses a plurality, nominally 2, of knife-type edges 16 and another plurality, nominally two, of spreader-type edges 17. The nominal two knife edges 16 are preferably equally orthogonally spaced with the nominal two spreader edges 17. The incorporation of spreader edges 17, as opposed to employment only of knife-type edges 16, prevents the severed material of the plastic cap 21 from flopping back or returning into the regions between the edges 16, 17 when the cap 21 is ruptured and penetrated by the penetrating and spreading member 13. This operation of the improved penetrating and spreading member 13 in accordance with the present invention is particularly shown in FIG. 5. Therein the knife-type edges 16 may be observed to have cut the plastic cap 21 whereas the spreader-type edges 17 may be observed to have bent or displaced the material of the cap 21 without cutting the same. The large orifice which is opened, and held open, within the punctured end of cap 21 illustrated in FIG. 5 does not impede the flow of water from the bottled water container 20 through the orifices 15 of the insert 10 and into the reservoir of the bottled water dispenser 30.

Further in accordance with the present invention, the vertical ribs 14 are sufficiently numerous, nominally 6 in number and are positioned at equal arcuate segments of 60 degrees, so as to insure that the neck of the bottled water container will not become wedged between adjacent ribs during insertion of the container within the insert and that the cap 21 will be automatically axially aligned with the penetrator.

Furthermore, the vertical ribs 14 may be observed to include elongated edge surfaces which are sized and adapted to frictionally engage the complementary exterior neck surface of a bottled water container 20 and or cap 21. The ribs 14, and the overall dispenser insert 10, are both sufficiently tall so that the insert may be frictionally retained on the neck of the bottled water container 20, and in position over the plastic seal 21, without necessitating the entrance of the penetrator element 13 into the seal 21. The dispenser insert 10 may thus be affixed about the neck of the container 20 and in position over the neck seal 21 prior to the inversion of such container 20 onto its location above bottled water dispenser 30. The insert 10 will remain frictionally attached to the neck of container 20 during the inversion, and the penetrator and spreading elements 13 will only penetrate the seal 21 at such time as the bottled water container 20 is fully and firmly seated within the inlet port to bottled water dispenser 30. This frictional engagement additionally prevents the water container from inadvertantly vertically rising off of the penetrator after depletion of the water contained therein which could occur due to the resiliency of the cap 21 upon the penetrator.

In addordance with the preceding discussion, the present invention will be understood to incorporate several improvements to a bottled water dispenser insert. Further, variations in the combination and/or application of these improvements will suggest themselves to a practitioner in the art of beverage dispensing system design. For example, once the spreading concept of the central element is recognized, then alternative penetrating/spreading edges could be employed. A hybrid penetrating edge which is initially knife-shape could, each one individually, turn to a blunter, spreading-type edge surface. In such a hybrid variation, there would not be distinct knife-type (only) surfaces and spreader-type (only) surfaces, but each surface would incorporate both knife-type and spreader-type features.

In accordance with these and other possible variations of the present invention, the invention should be interpreted in accordance with language of the following claims, only, and not solely in accordance with that particular embodiment within which the invention has been taught.

What is claimed is:

1. A bottled water dispenser insert comprising:

a dish-like member having an interior insertable intermediary, a reception port of a bottled water dispenser, and a water bottle inverted into the reception port;

a piercing member, affixed to the dish-like member, for penetrating and breaking a puncturable seal of the water bottle in order to permit flow of the water into the reception port, said member having a plurality of knife edges for penetrating and breaking the puncturable seal and having a plurality of separator edges for spreading the penetrated and broken material of the puncturable seal in order that the flow of water into the reception port may be substantially unobstructured; and a plurality of rib members formed on the interior of the dish-like member to guide and center the water bottle onto the piercing member, wherein the plurality of rib members are sized to frictionally grasp the water bottle in position about the puncturable seal so that, upon separation of an expended water from the bottled water dispenser, the dish-like member remains attached to the bottle against the force of gravity which tends to cause said member to remain proximate to the reception port of the dispenser.

2. A device for dispensing liquid beverages having a bottle-supporting, liquid-receiving vessel having dispensing means permitting liquid to be conducted therethrough and drawn therefrom as desired, and having an upper end opening for receiving the neck of an inverted bottle and having ann orifice in said upper end opening for receiving liquid from the inverted bottle, said device comprising;

a liquid-containing bottle having a neck and a neck opening, adapted to be inserted into the upper end opening of the vessel and to have said neck opening terminate proximate the orifice of the upper end opening, said bottle having a puncturable seal affixed to the bottle about said neck opening said seal maintaining the bottle closed even after the bottle has been inverted;

a seal-puncturing device adapted to puncture the bottle's seal as the bottle is lowered into the upper end opening and to project through the seal and into the neck opening of the bottle, the seal and the seal-puncturing device being constructed so that after the seal has been punctured, a flow opening will be formed between the punctured seal and the seal-puncturing device to permit liquid to flow freely from the bottle into the vessel's orifice, an improvement to the seal-puncturing device comprising:

a piercing member; and a plurality of rib members which guide and center the neck opening of the bottle into substantialy co-axial alignment with the piercing member, wherein the plurality of rib members frictionally grasp the puncurable seal so that, upon separation of an expended bottle from the vessel, the seal-puncturing device remains attached to the bottle against the force of gravity which tends to cause said member to remain proximate to the upper end opening of the vessel.

* * * * *